US008001622B1

(12) United States Patent
Culley et al.

(10) Patent No.: US 8,001,622 B1
(45) Date of Patent: Aug. 23, 2011

(54) PAD FOR HELMET OR THE LIKE

(75) Inventors: Brian J. Culley, Broadview Heights, OH (US); Mickey Smicklevich, Stow, OH (US)

(73) Assignee: Remington Products Company, Wadsworth, OH (US)

( * ) Notice: Subject to any disclaimer, the term of this patent is extended or adjusted under 35 U.S.C. 154(b) by 0 days.

(21) Appl. No.: 12/383,573

(22) Filed: Mar. 26, 2009

(51) Int. Cl.

| | |
|---|---|
| ***A41D 27/28*** | (2006.01) |
| ***A41B 3/12*** | (2006.01) |
| *A41D 27/12* | (2006.01) |
| *A41D 13/05* | (2006.01) |

(52) U.S. Cl. ..... 2/267; 2/410; 2/411; 2/412; 2/414

(58) Field of Classification Search ..... None
See application file for complete search history.

(56) References Cited

U.S. PATENT DOCUMENTS

| | | | | |
|---|---|---|---|---|
| 3,994,020 | A * | 11/1976 | Villari | 2/413 |
| 3,994,021 | A * | 11/1976 | Villari et al. | 2/413 |
| 4,060,855 | A * | 12/1977 | Rappleyea | 2/413 |
| 4,101,983 | A * | 7/1978 | Dera et al. | 2/412 |
| 4,441,211 | A * | 4/1984 | Donzis | 2/459 |
| 4,917,678 | A * | 4/1990 | Locke et al. | 606/133 |
| 6,228,933 | B1 * | 5/2001 | Hiles | 524/590 |
| 6,453,476 | B1 | 9/2002 | Moore, III | 2/412 |
| 6,476,113 | B1 * | 11/2002 | Hiles | 524/439 |
| 7,159,249 | B2 | 1/2007 | Dennis et al. | 2/421 |
| 2002/0058721 | A1 * | 5/2002 | Pachl et al. | 521/135 |
| 2002/0188997 | A1 * | 12/2002 | Lyden | 2/22 |
| 2003/0195268 | A1 * | 10/2003 | Freitag et al. | 521/130 |
| 2003/0195450 | A1 * | 10/2003 | Argenta | 602/75 |
| 2004/0102752 | A1 * | 5/2004 | Chen et al. | 604/378 |
| 2004/0107482 | A1 * | 6/2004 | Picotte | 2/411 |
| 2005/0116380 | A1 * | 6/2005 | Tadin | 264/223 |
| 2005/0251899 | A1 | 11/2005 | Dennis et al. | 2/414 |
| 2005/0261616 | A1 * | 11/2005 | Sklar et al. | 602/17 |
| 2005/0273911 | A1 * | 12/2005 | Skiba et al. | 2/412 |
| 2006/0277644 | A1 * | 12/2006 | Dobkin | 2/24 |
| 2006/0277647 | A1 * | 12/2006 | Dobkin | 2/69 |
| 2007/0281125 | A1 | 12/2007 | Moore, III et al. | 428/71 |

* cited by examiner

*Primary Examiner* — Bobby Muromoto, Jr.
(74) *Attorney, Agent, or Firm* — Renner, Kenner, Greive, Bobak, Taylor & Weber

(57) ABSTRACT

A pad (10), a plurality of which can be positioned in a helmet (21) or the like for comfort and protection, includes a first generally rectangular fabric material (11) having truncated corners (25). A first generally rectangular foam material (12) having truncated corners (24) includes a top surface, a bottom surface, and side surfaces (18), the top surface being attached to the first fabric material (11). A second generally rectangular foam material (14) having truncated corners (22) includes a top surface, a bottom surface, and side surfaces (19) having a scallop (23), the top surface being attached to the bottom surface of the first foam material (14). A second generally rectangular fabric material (16) having truncated corners (22) and sides having a scallop (23) is attached to the bottom surface of the second foam material (14). The side surfaces (18, 19) of the first and second foam materials (12, 14) are exposed. The first foam material (12) is an open-celled polyurethane, and the second foam material (14) is an impact rate dependent polyurethane having a thickness at least as great or greater than the thickness of the first foam material (12).

22 Claims, 3 Drawing Sheets

PAD FOR HELMET OR THE LIKE

TECHNICAL FIELD

This invention relates to a pad used for protection. More particularly, this invention relates to such a pad, a plurality of which may be positioned in a helmet or the like to provide comfortable protection.

BACKGROUND ART

People are involved in a number of endeavors which require that their bodies be protected. Many athletic participants, for example, are required to wear helmets, which helmets are provided with padding for protection of their heads. Similarly, other body parts may be in the need of padding during athletic events, such as the chest protectors of baseball catchers or umpires.

Military helmets, in particular, provide a special need for padded helmets. There, usually the inside of a helmet is provided with a plurality of pads which may be selectively positioned in the helmet dependent on the desire of the soldier. In addition, individual of the pads may be replaced, as needed or desired, when they become worn or otherwise damaged by moisture or the like.

One type of pad which is currently being used for these types of applications includes a foam material which is encapsulated in a plastic bag. One side of the foam is attached to a fabric material intended to be in a position to contact the head of the user when the pad is positioned in a helmet. Another layer of foam is attached to the other side of the bag and a loop fabric is attached to that foam layer and is adapted to be attached to hook pads positioned in the helmet to form the VELCRO® connection.

These pads not only require a tedious and expensive manufacturing process, but also are subject to premature deteriorization. In particular, with frequent removals and replacements, the integrity of the plastic bag can be invaded thereby rendering the pad useless for its intended purpose. Moreover, because of the generally shape of these pads, pads of three different sizes are required to properly fill a conventional military helmet. One size is typically used for the crown of the helmet; two trapezoidal pads are used for the brow and nape, front and back of the helmet, respectively; and four oblong pads are typically provided at the sides. Thus, three different types of pads must be inventoried for pad replacement purposes.

DISCLOSURE OF THE INVENTION

It is thus an object of one aspect of the present invention to provide a protective pad which is manufactured without the need of an encapsuling bag.

It is an object of another aspect of the present invention to provide a protective pad, as above, which is simple and inexpensive to manufacture.

It is an object of an additional aspect of the present invention to provide a protective pad, as above, which is constructed of materials designed to absorb forces while providing comfort to the user.

It is an object of yet another aspect of the present invention to provide a protective pad, as above, which is not subject to premature deteriorization.

It is an object of a further aspect of the present invention to provide a helmet with a plurality of protective pads of the present invention shaped to be conveniently positioned in the helmet.

It is an object of still another aspect of the present invention to provide a helmet, as above, with pads of all the same configuration.

These and other objects of the present invention, as well as the advantages thereof over existing prior art forms, which will become apparent from the description to follow, are accomplished by the improvements hereinafter described and claimed.

In general, a pad made in accordance with the present invention includes a first foam material having a top surface, a bottom surface, and side surfaces. A second foam material has a top surface, a bottom surface, and side surfaces, the top surface being attached to the bottom surface of the first foam material. A fabric material is attached to the bottom surface of the second foam material. The side surfaces of the first and second foam materials remain exposed. A helmet according to the present invention may be provided with a plurality of the pads just described.

In accordance with another aspect of the present invention, a pad includes a first foam material and a second foam material attached to the first foam material. A fabric material is attached to the second foam material. The first foam material is an open-celled polyurethane having a thickness, and the second foam material is a rate dependent, moisture-resistant polyurethane having a thickness at least as great or greater than the thickness of the first foam material. A helmet according to this aspect of the present invention may be provided with a plurality of the pads just described.

A pad made in accordance with yet another aspect of the present invention includes a first generally rectangular foam material having truncated corners. A second generally rectangular foam material is attached to the first foam material and has truncated corners and sides having a scallop, and a generally rectangular fabric material is attached to the second foam material and has truncated corners and sides having a scallop. A helmet according to this aspect of the invention may be provided with a plurality of the pads just described.

In another aspect of the present invention, the pad includes a first generally rectangular foam material has truncated corners, a top surface, a bottom surface, and side surfaces. A second generally rectangular foam material has truncated corners, a top surface, a bottom surface, and side surfaces having a scallop, the top surface being attached to the bottom surface of the first foam material. A generally rectangular fabric material has truncated corners and sides having a scallop and is attached to the bottom surface of the second foam material. The side surfaces of the first and second foam materials are exposed. The first foam material is an open-celled polyurethane having a thickness, and the second foam material is a rate dependent, moisture-resistant polyurethane having a thickness at least as great or greater than the thickness of the first foam material.

A preferred exemplary pad, and a helmet having a plurality of the pads, according to the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 5:
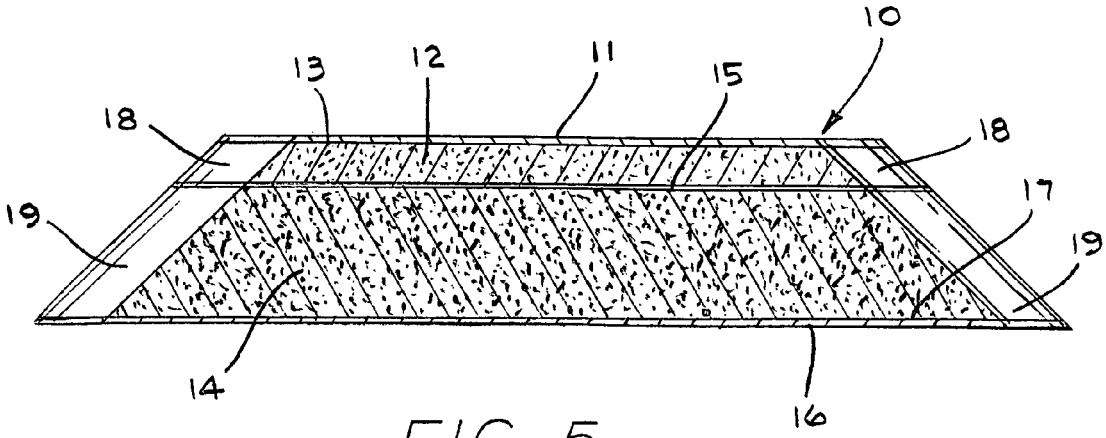
FIG. 5 is an enlarged sectional view taken substantially along line 5-5 of FIG. 1.

A pad made in accordance with the present invention is generally indicated by the numeral 10. As best shown in FIG. 5, pad 10 preferably includes four layers of material. At what can be called the top of pad 10 is optionally a thin layer of a polyester fabric material 11. Fabric 11 is attached to the top surface of an open celled polyurethane foam 12 by an adhesive 13. A SPUNFAB® PA 1541 adhesive sold by Keuchel Associates Inc. of Cuyahoga Falls, Ohio provides a suitable adhesive for adhesive 13. The bottom surface of foam 12 is attached to the top surface of a rate dependent polyurethane foam 14 by an adhesive 15. An EVER-LOCK® 2U333 adhesive sold by Forbs Adhesives, LLC of Research Triangle Park, North Carolina provides a suitable adhesive for adhesive 15. The bottom surface of foam 14 is attached to an unbroken loop fabric 16 by an adhesive 17. A SPUNFAB® VJ6010 adhesive provides a suitable adhesive for adhesive 17. Advantageously, the side peripheral edges 18 of foam 12 and the side peripheral edges 19 of foam 14 are exposed. It should also be noted that edges 18 and 19 are beveled such that the bottom surface of foam 14 is larger than its top surface, and the bottom surface of foam 12 (which is the same size as the top surface of foam 14) is larger than its top surface. Fabric 11 is the same size as the top surface of foam 12, and fabric 16 is the same size as the bottom surface of foam 14. The beveled edges 18 and 19 are preferably created during the manufacturing process by an art known as skiving which is an efficient way to form pad 10 and to advantageously reduce its weight.

Figure 6:
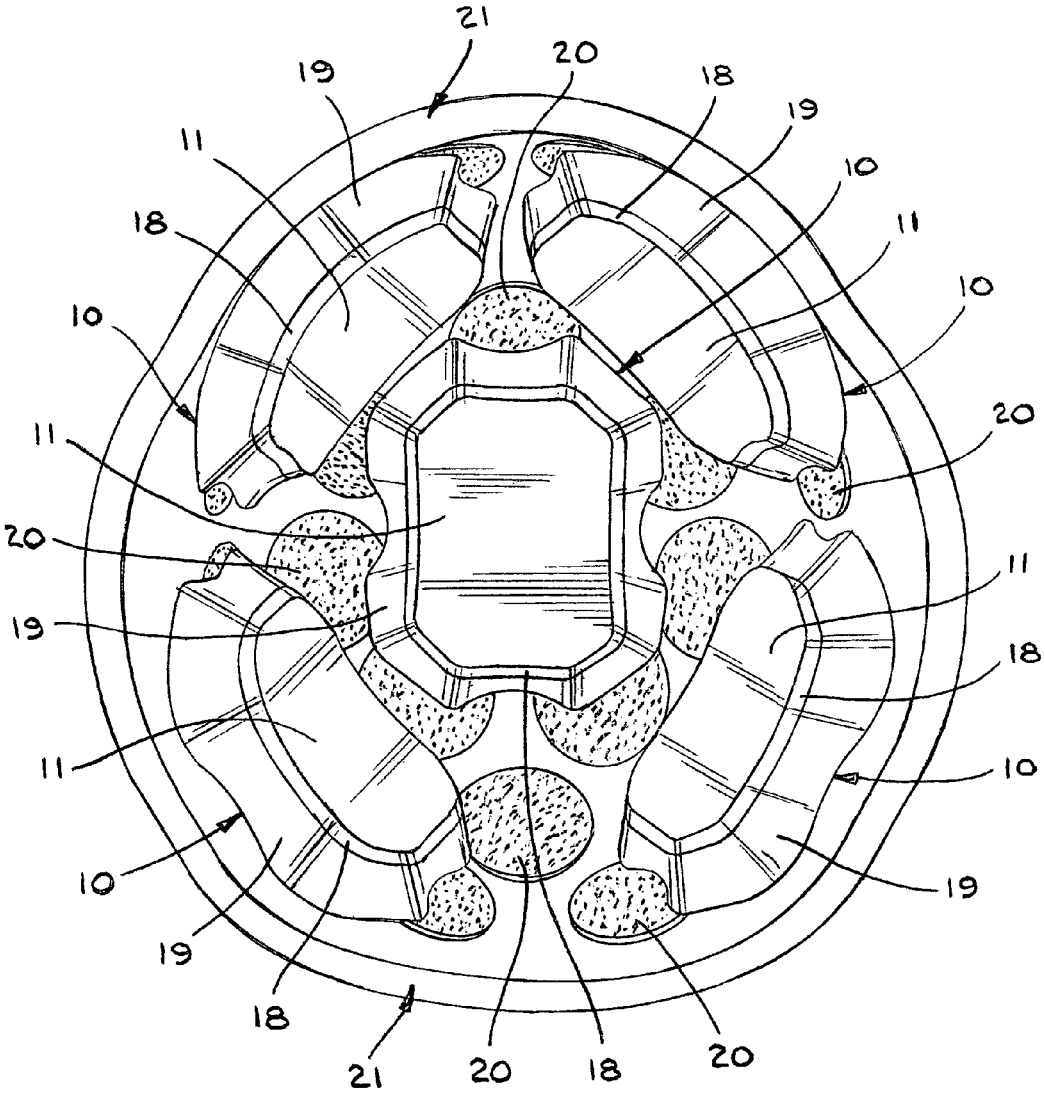
FIG. 6 is a plan view of the inside of a helmet having a plurality of pads of the present invention positioned therein.

As is known in the art, fabric 16 is a conventional unbroken loop fabric, and is adapted to be connected to the hook ends of a fabric, such as the disk-like pads 20 formed in the inside of a helmet generally indicated by the numeral 21 and shown in FIG. 6. Fabric 16 and pads 20 thus form a VELCRO® connection to hold pads 10 in the inside of helmet 21.

Fabric 11 can be formed of any comfortable material, and it has been found for that purpose that a polyester material having comfortable and moisture absorbing characteristics is suitable for fabric 11, which may include activated charcoal. When pads 10 are positioned in a helmet, as shown in FIG. 6, fabric 11 of each pad 10 is in a position to engage the head of the user, and hence its need to be comfortable and moisture absorbing.

Foam layer 12, positioned just below fabric 11, is preferably approximately one-eighth of an inch thick and is of the type of open-celled polyurethane foam which is shock absorbing and breathable, and which wicks away moisture. Such a foam may be a HYPUR-CEL® TO503 foam manufactured by Rubberlite, Inc. of Huntington, W. Va.

Foam layer 14 can be of the same thickness as foam layer 12 but is usually thicker than layer 12, and is shown as preferably being approximately five-eighths of an inch thick. Foam 14 can also be a polyurethane foam, but is advantageously a rate dependent, moisture-resistant foam. Rate dependent foams may be characterized as possessing a load-response behavior that resists sudden-movement rapid compression, yet is less resistive to slow-movement compression. In one or more embodiments, foam 14 exhibits the characteristics of impact attenuation with relatively rapid recovery from compression forces. By relatively rapid recovery is meant that foam 14 exhibits a recovery from compression forces that is more rapid than a viscoelastic foam. Thus, foam 14 is not a viscoelastic foam.

The rate of recovery from compression forces may be expressed as resilience, and the resilience of foam 14 is preferably greater than the resilience of viscoelastic foam. In one embodiment, the resilience of foam 14 is at least about 3, when measured using a Shore Instrument Resiliometer, according to the ASTM D 2632-96 Vertical Rebound test method. In another embodiment, the resilience of foam 14 is at least about 4 when so measured.

In one or more embodiments, foam 14 is an open cell polyurethane foam that is moisture resistant. By moisture resistant is meant that the properties of foam 14 do not irreversibly or permanently degrade upon exposure to moisture. In one or more embodiments, foam 14 is unaffected by mild organic acids and bases, shows only modest swelling with oils, greases and other linear hydrocarbons. Strongly polar solvents may swell the foam, however, physical properties of the foam recover to a great extent as the solvents evaporate. The water absorption exhibited by foam 14 is preferably lower than the water absorption of viscoelastic foam. In one embodiment, the water absorption of foam 14 is less than about 10%, measured as percent weight gain, based upon ASTM D570, 2 hour water immersion at room temperature. Advantageously, foam 14 is not degraded by exposure to moisture. Thus, in contrast to viscoelastic foam, foam 14 does not require a moisture barrier enclosure. In one or more embodiments, neither foam 14 nor pad 10 is sealed with moisture barrier spray, film or other layer.

Foam 14 can be characterized by one or more of the physical properties summarized in Table 1.

TABLE 1

| PROPERTY | TEST METHOD | PRODUCT RANGE |
|---|---|---|
| Density | ASTM D 3574-95 Test A | 9-25 |
| Air Permeability | Gurley Densometer | Open Cell—Breathable |
| Compression Set, % max | ASTM D 3574 Test D @ 158° F. (70° C.) | <10 |
| Compression Force Deflection, psi (kPa) | 0.2"/min. Strain Rate Force Measured @ 25% Deflection | 0.8-9.5 (6-66) |
| Hardness, Durometer | Shore "O" | 10-47 |
| Resilience, Shore Instrument Resiliometer, Avg (Ball Rebound Tester) | ASTM D 2632-96, Vertical Rebound | 3-10 |
| Water Vapor Transfer, Typical, g/ft$^2$/24 hrs | Sample Thickness, inches (mm) | 0.118 (3.0) |
| | Based on ASTM E96-00-Upright | 3000-3500 |
| | Based on ASTM E96-00-Inverted | 6000-35000 |
| Water Absorption, % wt gain | Based upon ASTM D570—2 h water immersion @ room temperature | 3.9-9.6 |
| Tear Strength, pli, min. | ASTM D624 Die C | 4.5-6 |
| Tensile Elongation, % min. | ASTM D 3574 Test E | >145 |
| Tensile Strength, psi, min (kPa) | ASTM D 3574 Test E | 30-60 (207-414) |

Polyurethane foams and test methods are more generally described in U.S. Published Patent Application No. 2002/01233929 A1, which is hereby incorporated by reference.

Examples of suitable foams include rate dependent foams such as PORON® XRD™ foams, available from Rogers Corporation, Rogers, Conn. A specific example of a suitable foam includes PORON® XRD™ 12625 foam.

Figure 1:
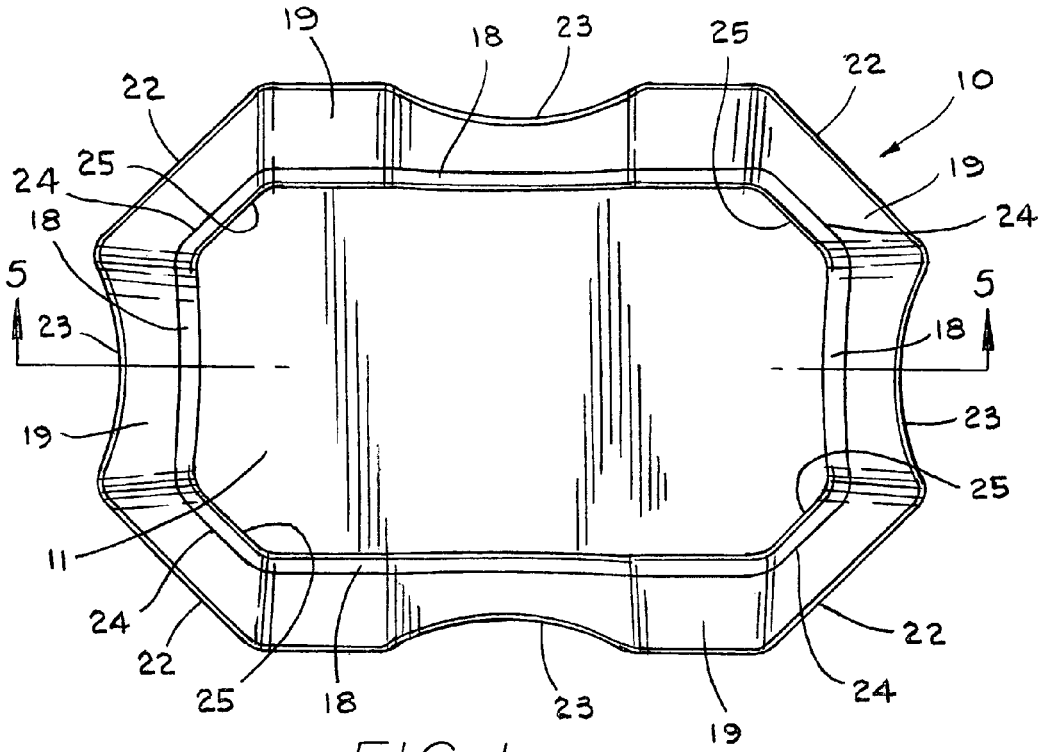
FIG. 1 is a top plan view of a pad made in accordance with the concepts of the present invention.
Figure 2:
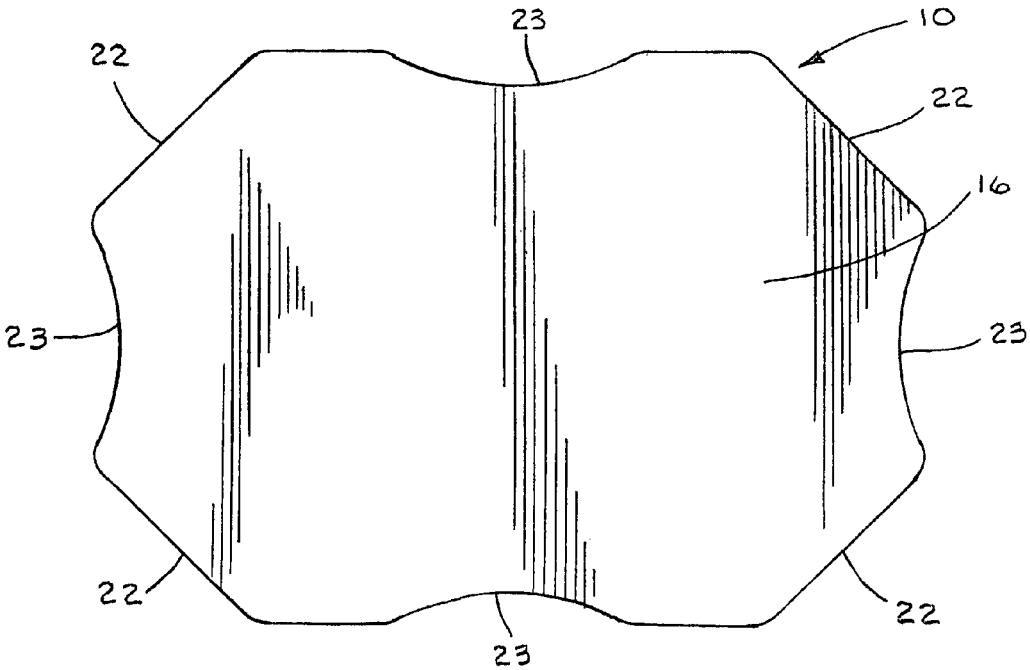
FIG. 2 is a bottom plan view thereof.
Figure 3:
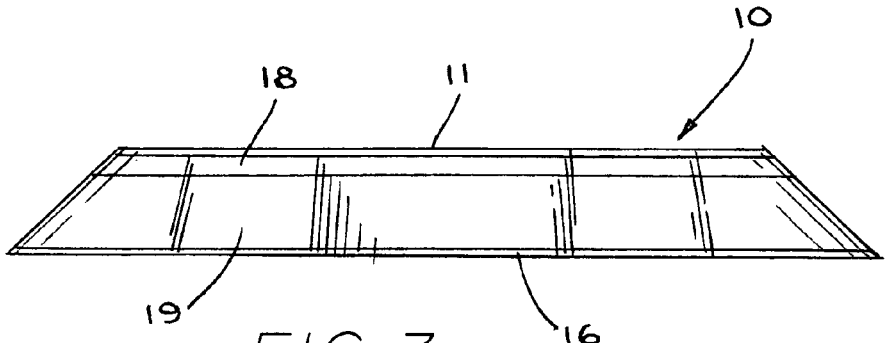
FIG. 3 is a front elevational view thereof.
Figure 4:
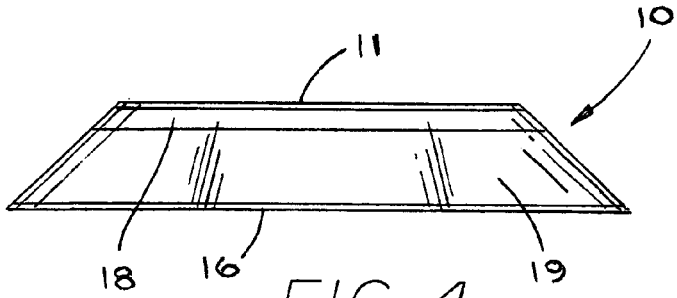
FIG. 4 is a side elevational view thereof.

While pad 10 could be formed in a rectangular block shape, for purposes of placement in helmet 21, as will be hereinafter described, and to economize on material and weight, pad 10 preferably takes on a special shape, in plan view, shown in FIGS. 1 and 2. Thus, the outside periphery of pad 10 is generally rectangular, but includes truncated corners 22 and sides having scallops 23 formed therein. As a result, foam layer 14 and fabric 16, which constitute the outside periphery of pad 10, thus includes truncated corners 22 and scallops 23. However, as foam 14 extends upwardly toward foam layer 12, scallops 23 generally disappear such that foam layer 12 is more substantially rectangular, but still having truncated corners 24. Similarly, fabric 11 is substantially rectangular with truncated corners 25.

As shown in FIG. 6, the inside of helmet 21 is adapted to receive five identical pads 10, as just described. The bottom unbroken loop fabric layer 16 of each pad 10 is adapted to engage a plurality of hook end disk pads 20 provided on the inside of the helmet. Thus, as shown, one pad 10 is positioned at the crown, two pads 10 are positioned to engage the front and front sides of the helmet, and two pads 10 are positioned to engage the rear and rear sides of the helmet. The truncated corners and scalloped shape of pads 10 better allows pads 10 to substantially fully envelope the inside of helmet 21 and yet allow a small amount of space therebetween so that the user can readily remove and reposition and/or replace a pad 10. Moreover, because of the symmetry of the shape of pads 10, they may be cut longitudinally in half to form half-pads for even more complete coverage within helmet 21.

Various aspects and features of the invention are illustrated in the following non-limiting examples.

EXAMPLES

Example 1 was a 1 inch thick sample of a rate dependent, moisture-resistant foam. Specifically, Example 1 was formed by combining two layers of PORON® XRD™ 12500 foam. Example 2 was a combination of a 0.5 inch thick viscoelastic foam layer, a 0.25 inch thick rate dependent, moisture-resistant foam layer, and a 0.125 inch thick non-rate dependent polyurethane foam layer. Accelerometer Impact Data was measured as follows:

Drop weight 11 lbs.
Drop height 0.48 meters
Drop velocity 3.03 meters/second
Drop timing 3 material impacts with 60-75 seconds between impacts
Sample dimensional size 5 inches by 7 inches Results are summarized in Table 2.

TABLE 2

| | EXAMPLE 1 | EXAMPLE 2 |
|---|---|---|
| HIT #1 (g) | 53 | 69 |
| HIT #2 (g) | 51 | 78 |
| HIT #3 (g) | 50 | 82 |
| AVERAGE (g) | 52 | 76 |

It can be seen that acceleration remains fairly constant from hit #1 to hit #3 for Example 1, while degradation is observed for Example 2. The degradation in Example 2 is believed to be due to the slower recovery from compression of the viscoelastic foam layer.

In view of the foregoing, it should thus be evident that a pad constructed as described herein accomplishes the objects of the present invention and substantially improves the art, and the placement of a plurality of the pads in a helmet results in an improved shock absorbing helmet.

What is claimed is:

1. A pad comprising a first foam material having a top surface, a bottom surface, and side surfaces; a second foam material having a top surface, a bottom surface, and side surfaces, said top surface of said second foam material being attached to said bottom surface of said first foam material; and a fabric material attached to said bottom surface of said second foam material; wherein said side surfaces of said first and second foam materials are substantially devoid of any covering material, for rapid release of moisture.

2. The pad of claim 1 further comprising a second fabric material attached to said top surface of said first foam material.

3. The pad of claim 2, said side edges of said first and second foam material being beveled such that said bottom surface of said first foam material is larger than said top surface of said first foam material, and said bottom surface of said second foam material is larger than said top surface of said second foam material.

4. The pad of claim 3 wherein said second fabric material is generally the same size as said top surface of said first foam material, said bottom surface of said first foam material is generally the same size as said top surface of said second foam material, and said fabric material is generally the same size as said bottom surface of said second foam material.

5. The pad of claim 1 wherein said first foam material is an open-celled polyurethane and said second foam material is an impact rate dependent polyurethane.

6. The pad of claim 2 wherein said second fabric material is a polyester and said fabric material is an unbroken loop fabric.

7. The pad of claim 5 wherein said side surfaces of said second foam material are equal to or greater in thickness than said side surfaces of said first foam material.

8. The pad of claim 2 wherein said fabric material, said second fabric material, and said first and second foam materials are generally rectangular having truncated corners, and said second foam material and said fabric material having sides with a scallop.

9. A pad comprising a first foam material, a second foam material attached to said first foam material, and a fabric material attached to said second foam material, said first foam material being an open-celled polyurethane having side surfaces defined by a thickness, and said second foam material being a rate dependent, moisture-resistant polyurethane having side surfaces defined by a thickness at least as great or greater than the thickness of said first foam material, said side surfaces of said first and second foam materials being substantially devoid of any covering material, for rapid release of moisture.

10. The pad of claim 9 wherein said second foam material is approximately five times thicker than said first foam material.

11. The pad of claim 9 further comprising a second fabric material attached to said first foam material.

12. The pad of claim 11 wherein said second fabric material is a polyester and said fabric material is an unbroken loop fabric.

13. The pad of claim 11 wherein said fabric material, said second fabric material, and said first and second foam materials are generally rectangular having truncated corners, and said second foam material and said fabric material having sides with a scallop.

14. A pad comprising a first generally rectangular foam material having side surfaces and having truncated corners, a second generally rectangular foam material attached to said first foam material and having truncated corners and sides surfaces having a scallop, and a generally rectangular fabric material attached to said second foam material and having truncated corners and sides having a scallop, said side surfaces of said first and second foam materials being substantially devoid of any covering material, for rapid release of moisture.

15. The pad of claim 14 further comprising a second fabric material having truncated corners and attached to said first foam material.

16. The pad of claim 14 wherein said sides of said second foam materials are beveled and said first foam material having sides that are beveled.

17. The pad of claim 16 wherein said truncated corners of said first and second foam materials are beveled.

18. The pad of claim 14 wherein is second foam material is the same thickness as, or thicker than, said first foam material.

19. A pad comprising a first generally rectangular foam material having truncated corners, a top surface, a bottom surface, and side surfaces; a second generally rectangular foam material having truncated corners, a top surface, a bottom surface, and side surfaces having a scallop, said top surface of said second foam material being attached to said bottom surface of said first foam material; and a generally rectangular fabric material having truncated corners and sides having a scallop and being attached to said bottom surface of said second foam material, said side surfaces of said first and second foam materials being exposed, said first foam material being an open-celled polyurethane having a thickness, and said second foam material being a rate dependent, moisture-resistant polyurethane having a thickness at least as great or greater than the thickness of said first foam material, said side surfaces of said first and second foam materials being substantially devoid of any covering material, for rapid release of moisture.

20. A helmet having a plurality of hook pads positioned on the inside thereof, and a plurality of pads according to claim 1 positioned in the helmet with said fabric material engaging selective of said hook pads.

21. A helmet having a plurality of hook pads positioned on the inside thereof, and a plurality of pads according to claim 9 positioned in the helmet with said fabric material engaging selective of said hook pads.

22. A helmet having a plurality of hook pads positioned on the inside thereof, and a plurality of pads according to claim 14 positioned in the helmet with said fabric material engaging selective of said hook pads.

* * * * *